United States Patent [19]

Takahashi et al.

[11] 3,976,420

[45] Aug. 24, 1976

[54] METHOD AND APPARATUS FOR BURNING FUELS

[75] Inventors: Yasuro Takahashi; Hisao Yamamoto, both of Nagasaki, Japan

[73] Assignee: Mitsubishi Jukogyo Kabushiki Kaisha, Japan

[22] Filed: Mar. 3, 1975

[21] Appl. No.: 554,703

[30] Foreign Application Priority Data

Mar. 5, 1974 Japan ..... 49-24778

[52] U.S. Cl. ..... 431/10; 431/174; 431/178

[51] Int. Cl.[2] ..... F23C 5/00

[58] Field of Search ..... 431/2, 8, 10, 284, 285, 431/174, 179, 175, 178; 239/423

[56] References Cited

UNITED STATES PATENTS 3,729,285 4/1973 Schwedersky ..... 431/8

3,890,084 6/1975 Voorheis et al. ..... 431/10

*Primary Examiner*—Edward G. Favors

*Attorney, Agent, or Firm*—McGlew and Tuttle

[57] ABSTRACT

Method and burner apparatus for burning fuels wherein an air-fuel premixture of a low fuel concentration formed by premixing a fuel with combustion air in an amount larger than the theoretical air amount necessary for combustion of said fuel is fed and burnt in a combustion zone, and simultaneously, a fuel and combustion air in an amount smaller than the theoretical air amount necessary for combustion of said fuel are fed separately and burnt in the vicinity of said combustion zone or an air-fuel premixture formed by premixing a fuel with a part of combustion air supplied in said amount and the remainder of said combustion air are fed separately in the vicinity of said combustion zone.

13 Claims, 6 Drawing Figures

METHOD AND APPARATUS FOR BURNING FUELS

Detailed Description of the Invention

Most of conventional burners are of the so-called diffusion flame type in which a fuel gas and combustion air are injected into a furnace through respective passages and the rate of mixing of the fuel gas and combustion air is determined mainly by the rate of diffusion of the fuel gas and combustion gas.

In burners of this type, as means for reducing nitrogen oxides in an exhaust gas there have heretofore been adopted the following methods:

1. A so-called two-staged combustion method in which a part of combustion air supplied in an amount larger than the theoretical air amount necessary for combustion of a fuel is injected from a burner (namely, the excess air ratio is reduced in the burner zone) and the remaining excessive air is injected from a port disposed separately from the burner.
2. A recycle gas-mixing method in which an inert gas (for example, a combustion exhaust gas) is incorporated in combustion air.
3. A non-uniform excess air ratio combustion method in which a plurality of burners are disposed and the air flow rate is made equal in all of the burners but the fuel flow rate is changed among respective burners.

It is known that these methods are more or less effective for reduction of nitrogen oxides in an exhaust gas. In FIG. 1 there are illustrated instances of results of our experiments made on these known methods using burners of the above-mentioned type. In FIG. 1, the ordinate indicates the nitrogen oxide concentration in an exhaust gas and the abscissa denotes the ratio of air passed through a burner throat (in the case of the two-staged combustion method air to be blown at the later stage of combustion is excluded to the theoretical air amount, namely the excess air ratio.

In FIG. 1, broken lines show experimental data obtained when the ratio (GM) of the amount of a combustion exhaust gas added to combustion air to the amount of said combustion air was changed in a conventional burner of the diffusion flame type.

As shown in FIG. 1, each curve showing the relation between the nitrogen oxide concentration in a combustion exhaust gas and the excess air ratio rises toward the right side and therefore, it is seen that the two-staged combustion method including reducing the excess air ratio in the burner zone is effective to some extent.

Further, since the nitrogen oxide concentration decreases with increase of the mixing ratio (GM) of a combustion exhaust gas to combustion air, it is seen that the recycle gas-mixing method is considerably effective.

However, even if the excess air ratio is made non-uniform among a plurality of burners and high excess air ratio combustion is conducted at one burner (for example, at the point *d* in FIG. 1) and low excess air combustion is conducted at another burner (for example, at the point e in FIG. 1), the effects offset each other and the nitrogen oxide concentration as a whole resides at, for example, the point *f* in FIG. 1. Accordingly, it can be said that the non-uniform excess air ratio combustion method is not very effective.

The two-staged combustion method and the non-uniform excess air ratio combustion methods are defective in that combustion is delayed in a low excess air ratio combustion zone and some amount of unburnt components is observed. The recycle gas-mixing method is defective in that a fan should be provided for feeding a recycle gas and a great power is required for operation of this fan.

A combustion method not using a conventional burner of the diffusion flame type is also known as means for reduction of nitrogen oxides in exhaust gases. According to this method, two premixture flames differing in the fuel/air ratio are combined, whereby amounts of nitrogen oxides formed can be greatly reduced as compared with the conventional methods. This method, however, is defective in that since fuel and air are uniformly mixed in advance, when the injection flow rate is lowered, backfire is sometimes caused and the range for adjustment of loads is narrower than in the conventional methods.

This invention can overcome the foregoing defects involved in the conventional methods and is characterized by the following two points:

1. Two systems are provided for each of a fuel and combustion air. One fuel system and one combustion air system are used for premixing the fuel and combustion air before the outlet of a burner to form a so-called premixture flame. The remaining fuel and combustion air systems are used for feeding a fuel and combustion air separately to the outlet of the burner to form a so-called diffusion flame. Alternatively, these remaining systems are used for premixing a part of combustion air with the fuel before the outlet of the burner as in the case of a Bunsen burner and feeding the remainder of air downstream of the outlet of the burner to form a partial premixture flame.
2. In the premixture flame portion, the fuel/air ratio is maintained at a low level and in the diffusion flame or partial premixture flame portion, the fuel/air ratio is maintained at a high level, so that an appropriate excess air ratio can be maintained as a whole in the burner.

This invention will now be illustrated in detail by reference to the accompanying drawings, in which:

FIG. 1 illustrates experimental results about discharge of nitrogen oxides in premixture flame burners.

As is seen from these experimental results, the relation between the nitrogen oxide concentration and the excess air ratio in the premixture flame burner, which is shown by solid lines, is quite different from the same relation in the conventional methods using a diffusion flame burner, which is shown by broken lines. Namely, the relation is expressed by a steep mountain-like curve having an apex at a point of an excess air ratio of about 1.0 to about 1.1. Accordingly, as the excess air ratio is increased, the nitrogen oxide concentration is drastically reduced to a level not attainable by the conventional methods.

The effects attained by this invention will now be described.

Figure 1:
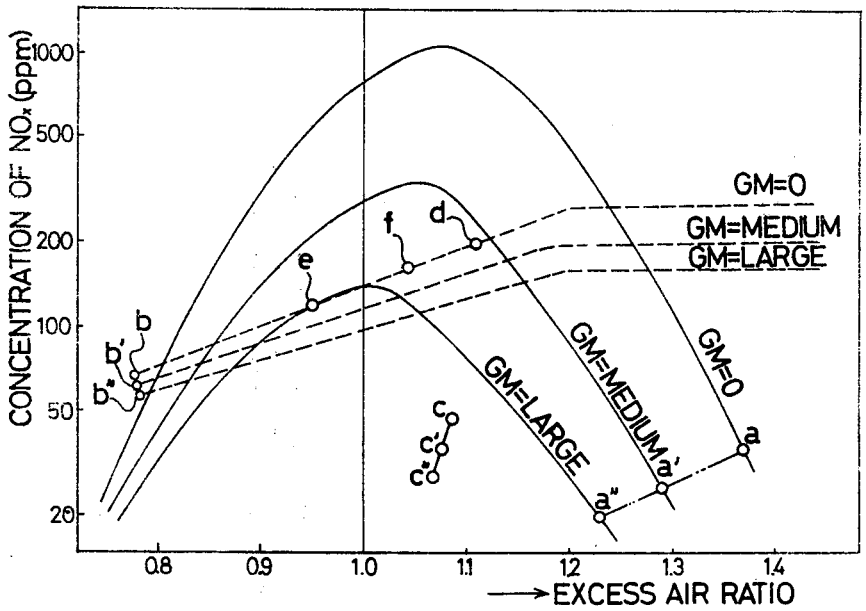
FIG. 1 is a curve illustrating the relation between the excess air ratio in the burner zone and the nitrogen oxide concentration.

In FIG. 1, the point *a* indicates the operation point for a premixture flame portion in which the excess air ratio is maintained at a level higher than 1.0 and the point *b* indicates the operation point for a diffusion flame (or partial premixture flame) portion in which the excess air ratio is maintained at a level lower than 1.0.

In the premixture flame portion, since the fuel is mixed in advance with a sufficient amount of combustion air, combustion is completed in a very short time in the outlet of the burner, and the nitrogen concentration is maintained at a level of the point *a* in FIG. 1. However, in the diffusion flame or partial premixture flame portion, since the amount of air is scanty, combustion is gradually advanced by diffusion of an excessive oxygen-containing combustion gas formed in the premixture flame portion and is completed in a relatively long time. Accordingly, formation of nitrogen oxides in the diffusion flame or partial premixture flame portion is maintained at a level substantially equal to the level attained in the conventional recycle gas-mixing method. Therefore, when the premixture flame is combined with the diffusion flame or partial premixture flame, the final amount of formed nitrogen oxides is represented by the weight average of nitrogen oxides generated from both the flames, and it can be maintained at a much lower lever (point *c* ) than in the conventional recycle gas-mixing method. If in the above-mentioned burner a combustion exhaust gas is incorporated to shift the operation point *a* to a point *a'* or *a''* and to change the operation point *b* to a point *b'* or *b''*, it is made possible to reduce the total amount of nitrogen oxides formed by combustion to the point *c'* or *c''*.

Figure 2:
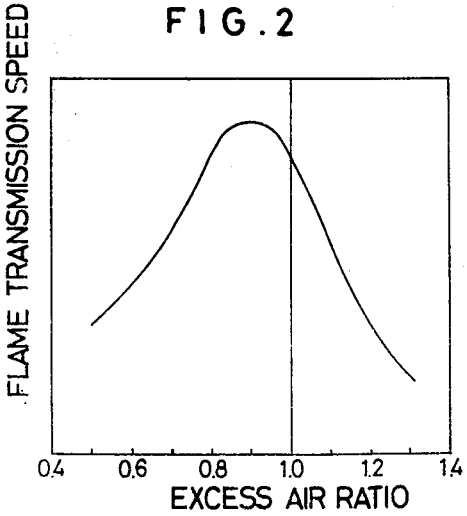
FIG. 2 is a curve illustrating the relation between the excess air ratio in the burner zone and the flame propagation speed.

As is shown in FIG. 2, the flame propagation speed of the air-fuel premixture is highest when the excess air ratio is about 0.9 to about 1.0, and when the excess air ratio increases or decreases, in both cases departing from this point, the flame propagation speed is reduced. In operation of a furnace where burner combustion is performed, if it is intended to reduce the burner load, the operation is generally conducted at an excess air ratio higher than in the case of the full load operation, in view of characteristics of the adjustment device. Accordingly, in the case of a burner in which two premixture flames differing in the fuel concentration are employed, when the burner load is reduced, the overall excess air ratio in the burner increases, and in accordance therewith the injection speed of a low excess air ratio air-fuel premixture is lowered as the excess air ratio of said fuel rich premixture approaches 1.0 but the flame propagation speed increases on the contrary. Therefore, backfire is readily caused to occur. According to this invention, however, since the portion of the burner corresponding to this low excess air ratio premixture portion is constructed so that a diffusion flame is formed, no backfire is caused and combustion can be performed stably. When the above-mentioned portion of the burner is constructed so that a partial premixture flame is formed, since the excess air ratio in the partial premixture flame portion is maintained at a very low level, the flame propagation speed in the premixture flame portion is not heightened to such a level as will cause backfire, even if the overall air excess ratio in the burner is increased, and therefore combustion can be performed very stably.

Also in this invention, the burner is so constructed that a high excess air ratio fuel/air premixture can form a suitable premixture flame, but in this invention there is no fear of backfire even if the burner load is lowered. More specifically, when the burner load is reduced, although the injection speed is lowered as the excess air ratio is increased but since the flame propagation speed is lowered, no backfire is caused to occur.

As means for practising the above-mentioned combustion process of this invention advantageously, in accordance with this invention there is provided a burner apparatus which comprises a premixture fuel feed nozzle including means for premixing a fuel and combustion air in an amount larger than the theoretical air amount necessary for combustion of said fuel before the outlet of a burner, namely means for forming a so-called low fuel concentration premixture fuel, and a fuel-injecting nozzle including a fuel feed pipe for feeding a fuel and an air feed pipe for feeding air in an amount smaller than the theoretical air amount necessary for combustion of said fuel from the peripheral portion of the fuel feed pipe.

Since the burner apparatus of this invention comprises both a nozzle for feeding a premixture fuel and a fuel-injecting nozzle for forming a diffusion flame or partial premixture flame, the combustion state is always stable. Further, the structure of the apparatus is very simple and it can be attached to a combustion chamber very easily. Moreover, the apparatus can be manufactured at a low cost. By using this burner apparatus, the above-mentioned combustion process of this invention can be worked very advantageously.

An embodiment in which the burner apparatus for practising the method of this invention is used for combustion of a fuel gas or gaseous fuel formed by vaporizing or gasifying a liquid fuel will now be described by reference to FIGS. 3 and 4.

Figure 3:
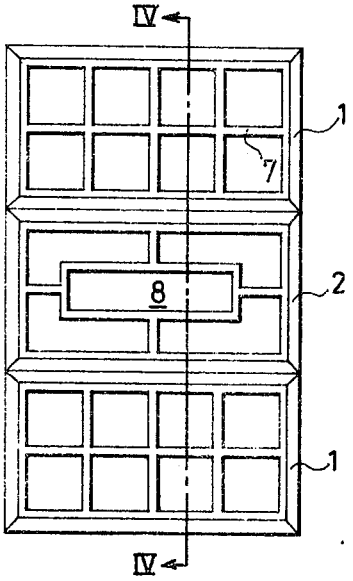
FIGS. 3 and 4 are front and sectional side views of an example of the burner to be used in this invention.
Figure 4:
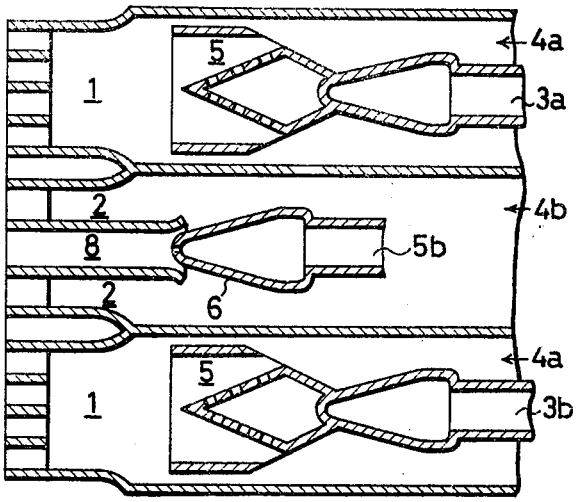

Referring to FIGS. 3 and 4, nozzles 1 and 2 constitute one burner, and the nozzle 1 is a nozzle for forming a premixture flame and the nozzle 2 is a nozzle for forming a partial premixture flame. A gaseous fuel is fed from fuel feed pipes 3*a* and 3*b*, and the gaseous fuel fed from the feed pipe 3*a* is premixed with combustion air 4*a* (optionally mixed with a combustion exhaust gas) in a premixer 5. Reference numerals 6 and 7 denote a gaseous fuel injector and a flame-retaining device, respectively, and reference numeral 8 denotes a partial premixture-forming portion for mixing the gaseous fuel from the feed pipe 3*b* with a small amount of combustion gas (optionally mixed with a combustion exhaust gas).

In FIG. 4, the fuel feed rate is changed between the fuel feed pipes 3*a* and 3*b* or the air flow rate is made different between the nozzles 1 and 2 so that the excess air ratio is higher than 1 in the nozzle 1 and the excess air ratio is lower than 1 in the nozzle 2.

In the burner apparatus shown in FIGS. 3 and 4, a gaseous fuel introduced from the gaseous fuel feed pipe 3*a* is premixed with combustion air 4 in an amount larger than the theoretical amount necessary for combustion of the gaseous fuel (for example, the air amount is so adjusted that the excess air ratio, namely the ratio of the actually used amount of air to the theoretical air amount, is within a range of from 1.2 to 1.4) in the premixer 5, and the premixture is injected from the nozzle 1 to form a premixture flame. A gaseous fuel feed pipe 3*b* is fed to the partial premixture-forming portion 8 of the nozzle 2 together with a small amount of combustion air, mixed uniformly therewith and injected from the top end of the partial premixture-forming portion 8. Simultaneously, combustion air is fed from the periphery of the partial premixture-forming portion 8 to form a partial premixture flame. The amount of this combustion air is so controlled that the sum of said smaller amount of combustion air and the amount of this combustion air is smaller than the theoretical air amount necessary for combustion of the gaseous fuel fed from the gaseous fuel feed pipe 3*b* (for example, an excess air ratio of 0.5 to 0.8). This burner apparatus comprises both nozzle 1 for forming a premixture flame and the nozzle 2 for forming a partial premixture flame. Accordingly, the combustion state is always stable. Further, the structure of the apparatus is very simple and it can be attached to a combustion chamber very easily. Moreover, the apparatus can be manufactured at a low cost. By using this burner apparatus, the combustion process of this invention can be worked very advantageously.

Another embodiment in which a liquid fuel is fed to the diffusion flame-forming portion and a gaseous fuel is fed to the premixture flame-forming portion will now be described by reference to FIGS. 5 and 6.

Figure 5:
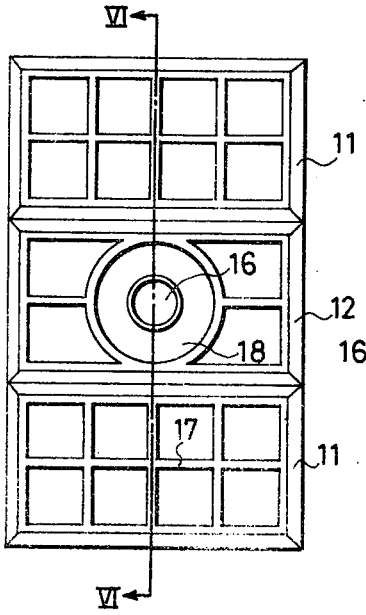
FIGS. 5 and 6 are front and sectional side views of another example of the burner to be used in this invention.
Figure 6:
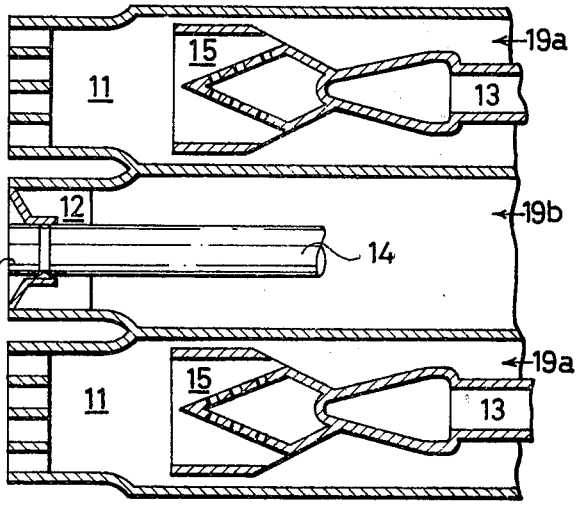

Referring to FIGS. 5 and 6, nozzles 11 and 12 constitute one burner, and the nozzle 11 is a nozzle for forming a premixture flame and the nozzle 12 is a nozzle for forming a diffusion flame. Reference numerals 13, 14, 15, 16, 17 and 18 denote a gaseous fuel feed pipe, a liquid fuel feed pipe, a premixer for premixing the gaseous fuel with combustion air, a liquid fuel spray nozzle, a flame retainer for a premixture gas flame, and a flame retainer for a diffusion flame respectively. 19*a* and 19*b* indicate combustion air.

In FIG. 6, the fuel feed rate is changed between the fuel feed pipes 13 and 14 or the air flow rate is changed between the nozzles 11 and 12, so that the excess air ratio in the premixture flame portion is different from the excess air ratio in the diffusion flame portion.

This embodiment differs from the above-mentioned embodiment shown in FIGS. 3 and 4 only in the point that a diffusion flame is formed with a liquid fuel in the portion corresponding to the partial premixture flame-forming portion in the above embodiment, and the functions and effects are the same as in the above embodiment. Therefore, detailed explanation of this embodiment is omitted.

As is apparent from the above detailed description made by reference to the two embodiments shown in the drawings, in accordance with this invention, there are provided a process for burning fuels comprising feeding and burning in a combustion zone an air-fuel premixture of a low fuel concentration formed by premixing a fuel with combustion air in an amount larger than the theoretical air amount necessary for combustion said fuel, and simultaneously feeding separately and burning in the vicinity of said combustion chamber a fuel and combustion air in an amount smaller than the theoretical air amount necessary for combustion of said fuel, or feeding separately and burning in the vicinity of said combustion chamber an air-fuel premixture of a fuel and a part of combustion air supplied in said amount and the remainder of said combustion air and a burner apparatus which comprises at least one premixture fuel feed nozzle including means for premixing a fuel and combustion air in an amount larger than theoretical air amount necessary for combustion of said fuel before the outlet of a burner and at least one fuel-injecting nozzle including a fuel feed pipe for feeding a fuel and an air feed pipe for feeding air in an amount smaller than the theoretical air amount necessary for combustion of said fuel from the peripheral portion of the fuel feed pipe.

According to the combustion process of this invention, a fuel-air premixture of a low fuel concentration (high excess air ratio) is prepared and burnt to form a premixture flame, and simultaneously, a diffusion or partial premixture flame of a low excess air ratio is formed. Therefore, generation of $NO_x$ (nitrogen oxides) is inhibited and occurrence of backfire to otherwise be caused readily in a premixture flame of a high fuel concentration is completely prevented. In the burner apparatus of this invention, since an air-fuel premixture feed nozzle and a fuel-injecting nozzle are provided in combination, a stable combustion state can always be obtained. Further, the structure of the apparatus is very simple and it can be attached to a combustion chamber very easily. Moreover, the apparatus can be manufactured at a low cost. Accordingly, by using this burner apparatus, the combustion process of this invention can be worked very advantageously.

What is claimed is:

1. A process for burning fuels comprising feeding and burning in a combustion zone an air-fuel premixture of a low fuel concentration formed by premixing a fuel with combustion air in an amount larger than the theoretical air amount necessary for combustion of said fuel, and simultaneously feeding separately and burning in the vicinity of said combustion zone a fuel and combustion air in an amount smaller than the theoretical air amount necessary for combustion of said fuel, or feeding separately and burning in the vicinity of said combustion zone an air-fuel premixture of a fuel and a part of combustion air supplied in said amount and the remainder of said combustion air.

2. A burner apparatus which comprises at least one premixture fuel feed nozzle including means for premixing a fuel and combustion air in an amount larger than the theoretical air amount necessary for combustion of said fuel before the outlet of a burner and at least one fuel-injecting nozzle including a fuel feed pipe for feeding a fuel and an air feed pipe for feeding air in an amount smaller than the theoretical air amount necessary for combustion of said fuel from the peripheral portion of the fuel feed pipe.

3. A method of burning fuels comprising introducing a first quantity of fuel into an airstream of a first quantity of air to mix the first quantity of fuel and the first quantity of air while the first quantity of fuel and first quantity of air are supplied in quantities such that there is an excess of air required for theoretical optimum combustion so as to form a mixture of fuel and excess air, discharging the mixture of fuel and excess air into a combustion zone to ignite and burn the mixture of fuel and excess air, and simultaneously directing a second quantity of fuel and a second quantity of air into the combustion zone in quantities such that the second quantity of air is supplied in an amount smaller than that necessary for optimum combustion and so that the second quantity of fuel is completely combusted without backfire with a portion of the first quantity of air in said mixture.

4. A method according to claim 3, wherein the second quantity of fuel and the second quantity of air are directed into the combustion zone without mixing.

5. A method according to claim 3, wherein at least a portion of said second quantity of fuel is mixed with said second quantity of air before it is directed into the combustion zone.

6. A method according to claim 3, wherein a third quantity of fuel is directed into an airstream with a third quantity of air to mix the fuel and air while supplying the fuel and air in quantities such that there is an excess of air required for theoretical optimum combustion and to form a second mixture of fuel and excess air and wherein the second quantity of fuel and second quantity of excess air are directed centrally between said mixture and said second mixture.

7. A method according to claim 6, wherein the fuel comprises a gas.

8. A method according to claim 6, wherein the fuel is a liquid.

9. A burner construction, comprising wall means defining a burner end face terminating in a combustion zone, a first air conduit having a discharge into said combustion zone, a first fuel conduit directly adjacent said first air conduit having a first fuel discharge into said combustion zone, means for supplying air to said first air conduit in an amount less than that necessary for the optimal combustion of the fuel, at least one second air conduit having a discharge into said combustion zone, a second fuel conduit having discharge mixer means for discharging fuel into the air conduit and for mixing the fuel with the air, and means for supplying fuel and air to said second air conduit and said second fuel conduit in quantities such that the air is supplied in an amount in excess of that required for optimal theoretical combustion with said second fuel quantity.

10. A burner according to claim 9, including a premixed conduit terminating in the combustion zone and having an inner end spaced inwardly therefrom, said second fuel conduit having a discharge centrally into the diffuser conduit, the space around said second fuel conduit defining with said diffuser conduit a flow space for air or partial premixing of air from said second air conduit with the fuel from the second fuel conduit.

11. A burner according to claim 9, wherein said second fuel conduits at said end face and comprises a conduit for liquid fuel having a discharge at said burner face.

12. A burner according to claim 9, wherein said discharge mixer means includes a premixer conduit arranged in said second air conduit, said second fuel conduit terminating in a nozzle within said premixer conduit, the space between said nozzle and said premixer conduit defining a flow space for the air from said second air conduit.

13. A burner according to claim 9, including a third air conduit having a discharge into said zone, a third fuel conduit having discharge mixer means for discharging fuel from said third fuel conduit into said third air conduit for mixing the fuel with air therein, said first fuel conduit and said first air conduit being located centrally in respect to said second air conduit and second fuel conduit and said third air conduit and third fuel conduit.

* * * * *